US007980033B1

(12) United States Patent
Fyfe

(10) Patent No.: US 7,980,033 B1
(45) Date of Patent: Jul. 19, 2011

(54) SYSTEM AND METHOD FOR INCREASING THE SHEAR STRENGTH OF A STRUCTURE

(75) Inventor: Edward R. Fyfe, Del Mar, CA (US)

(73) Assignee: Fyfe Co. LLC, San Diego, CA (US)

( * ) Notice: Subject to any disclaimer, the term of this patent is extended or adjusted under 35 U.S.C. 154(b) by 23 days.

(21) Appl. No.: 12/459,013

(22) Filed: Jun. 25, 2009

Related U.S. Application Data

(63) Continuation-in-part of application No. 11/399,282, filed on Apr. 6, 2006, now Pat. No. 7,574,840, which is a continuation-in-part of application No. 10/205,294, filed on Jul. 24, 2002, now Pat. No. 7,207,149.

(51) Int. Cl.
*E04B 1/00* (2006.01)
*E04B 2/00* (2006.01)
*E04B 2/56* (2006.01)

(52) U.S. Cl. ..... 52/271; 52/223.13; 52/223.14; 52/582.1; 52/583.1; 52/586.1

(58) Field of Classification Search ..... 52/223.7, 52/236.8, 236.9, 251, 283, 583.1, 585.1, 52/742.14, 747.12, 361–363, 344, 782, 796.1, 52/223.9, 706–708, 271–272; 403/169.1–170, 172

See application file for complete search history.

(56) References Cited

U.S. PATENT DOCUMENTS 2,371,882 A * 3/1945 Freyssinet ..... 52/223.13
3,222,842 A * 12/1965 Luedloff et al. ..... 52/741.11
3,820,832 A * 6/1974 brandestini et al. ..... 24/115 A
4,866,897 A * 9/1989 Yount ..... 52/363
5,809,712 A * 9/1998 Simanjuntak ..... 52/223.7

* cited by examiner

*Primary Examiner* — Jeanette E. Chapman
(74) *Attorney, Agent, or Firm* — Palomar Patent; Mary Jo Redman; Calif Tervo

(57) ABSTRACT

Reinforcing system for retrofitting wall to increase the ductility and resistance to shear forces of a gypsum board wall to a level comparable to plywood-sheathed wall. Fiber-reinforced polymer panel is attached to substantially cover surface of gypsum board to protect it against rupture in earthquake. Reinforcement is enhanced by fiber anchors installed along base of wall and door frames. Optional connector strips tie together door and window frames to prevent separation from wall.

6 Claims, 2 Drawing Sheets

SYSTEM AND METHOD FOR INCREASING THE SHEAR STRENGTH OF A STRUCTURE

CROSS-REFERENCE TO RELATED APPLICATIONS

This application is a Continuation-in-Part of application Ser. No. 11/399,282, filed Apr. 6, 2006 now U.S. Pat. No. 7,574,840, which is itself a C-I-P of application Ser. No. 10/205,294, filed Jul. 24, 2002, which issued Apr. 24, 2007 as U.S. Pat. No. 7,207,149. These previous applications are incorporated herein by reference.

FIELD OF THE INVENTION

This invention relates in general to reinforcing a structure, and more particularly to increasing the shear resistance of an existing structure.

BACKGROUND OF THE INVENTION

Buildings have traditionally been designed to support their own weight plus that of expected inhabitants and furnishings. Buildings and other structures for supporting weight have long been expected to be very strong under vertical compression. Concrete is a favorite material for weight-bearing structures because it is inexpensive and has exceptional compressive strength.

In the mid-1900s, architects began to take lateral forces into account more than they had previously. Wind can exert strong lateral force on tall buildings and long bridges. Smaller structures were still designed without much regard for strong lateral forces, though, until concern for earthquake resistance began growing in the 1970s in the United States, partly due to the massive Anchorage earthquake in 1964.

Frame structures consist of a skeleton of elongate wood, metal, or concrete members that are connected together. These elongate members may be connected together by various means. In some cases brackets that join elongate members while resisting twist are used. More typically, framing members are connected with nails or screws that are easily bent and that can allow the framing members to pivot about the connection when under stress from an unusual direction.

Once the framework skeleton is complete, a sheathing of some material is applied over the framing to give a smooth surface and to increase the shear resistance of the wall. Such a sheathing material is typically plaster, wood paneling including plywood, or gypsum board, also known as drywall or sheetrock.

The stiffness of the sheathing material helps maintain the framework erect under lateral forces such as earthquake or high wind. Building codes take this effect into account and allow designers to include fewer diagonal braces or other shear reinforcements than would be required for unsheathed frame walls. Because various sheathing materials are known to have different shear strength values, there are different code requirements for constructing the frame, depending upon the planned sheathing material.

The shear strength values were formerly derived from small scale mechanical tests of the materials themselves. Testing of construction materials has become more realistic and sophisticated in the past few decades. As a result, some of the previously used strength values have been found to be inaccurate.

In particular, buildings that use gypsum board for interior walls, also called drywall construction, have been found to have much less resistance to lateral forces than their designers intended. For many years, designers used an erroneously high value for the shear resistance of walls faced with gypsum board. Later research, as well as analysis of buildings damaged by earthquake or wind, has shown that the true shear resistance contribution of gypsum board is only about 10% of what was previously accepted.

Many buildings worldwide need to be retrofitted so as to have the desired degree of shear force resistance. A conventional method for strengthening such buildings is to pull out the gypsum board and replace it with plywood that is attached to the building framework.

Replacing gypsum board with plywood is an effective method for increasing the resistance to lateral forces, but has disadvantages. The "demolition" step of removing the gypsum is extremely dusty, releasing particles into the atmosphere of the building and generating larger particles that drop to flat surfaces and into crevices. Between disposal of the bulk of the gypsum board and the cleanup of the building, a great deal of solid waste is created.

The dust may include gypsum, asbestos, and paper. Because dust in the air is harmful to people, animals, and many machines, the contents of the building have to be wrapped, packed, or removed so they are not contaminated. Residents or workers in the building being retrofitted may be required to absent the building for a day or longer.

Both the steps of demolition and of installing plywood are noisy for the entire duration of the work. Even if people and machines in the building can be isolated from the dust by temporary walls, such as of plastic sheeting, it is likely that the noise of the operation would prevent occupants from working or resting in the building during the retrofitting.

Simply replacing the drywall sheathing of interior walls with plywood may not be enough to increase the strength of the structure as much as desired. Additional wooden bracing within the walls or use of metal tie straps to connect various components of the structure together may be needed.

To withstand lateral forces such as seismic or wind forces, a structure's components must be strongly connected together. Yet, it has been found that extremely rigid structures do not fare as well in earthquakes or wind as structures with some flexibility. Replacing gypsum board with nailed-in plywood does not significantly improve the ductility of the structure. If additional internal bracing or metal connectors must be installed, the ductility of the structure may be actually reduced, leaving the structure still vulnerable to cracking or rupturing under strong lateral force. A violent failure of one component of a structure often causes a sudden chain reaction failure of other components, possibly trapping or crushing occupants. A ductile structure is more likely to fail in a gradual manner, allowing time for occupants to notice the impending failure and take steps to evacuate.

Seismic retrofitting by replacing gypsum board with plywood is expensive and is therefore typically being done on only the highest-risk structures. Costs of the method include loss of productivity and use of the building during the retrofitting, potential cost of temporarily relocating occupants, dust abatement and cleanup, cost of demolition labor and disposal fees for the gypsum, cost of protecting contents of the building, cost of additional bracing and reinforcing, and cost of the plywood itself and its installation. Lastly, after the walls are replaced, paint, trim, wallpaper and other ornamental finishes must be replaced.

The need for a less costly method of seismic retrofitting of drywall structures is great. Such a method should provide shear resistance that is at least equivalent to that of plywood. There is a need for such a retrofit method that does not generate large quantities of solid waste and that does not contaminate the structure with harmful dust and particles.

There is further a need for a retrofit method that can be performed while people work or live in the building, without undue noise or exposure to harmful materials. Such a retrofit method should preferably make it more likely that any failure of the structure, if it does occur, is gradual instead of sudden and catastrophic so that occupants may escape.

SUMMARY OF THE INVENTION

The present invention is a system for increasing the shear resistance of gypsum sheathed walls and optionally reinforcing the attachment between multiple structural components. A structure reinforced by the materials and method of the invention is less likely to fail under lateral forces, such as those experienced during an earthquake, hurricane, or explosion.

The resistance to shear forces of structures reinforced by the system of the present invention is at least as great as that of structures reinforced by the conventional replacement of gypsum with plywood. However, the apparent ductility of the structure is greater and the total cost is significantly lower.

Using the system of the present invention, retrofitting can be performed while people occupy the building, without creation of dust and with much less noise than is made during the conventional procedure. Much less solid waste material is created.

The method of the present invention includes covering gypsum wallboard with thin composite sheeting, such as panels of polymer-impregnated textile. Ductile attachment means, preferably fiber anchors as disclosed in U.S. Pat. No. 7,207,149, are installed to connect the covered wall to an adjacent structural component such as a concrete slab or frame member.

If connecting straps are needed for additional connection among structural components such as door frames or between floors of multilevel buildings, long strips of composite are applied where needed on the outer surface of the gypsum wallboard. No bracing inside of the wall is necessary and the gypsum board remains in place throughout the structure.

This method is fairly quiet and dustless, so therefore does not require relocation or protection of occupants and equipment. The composite panels used contain only small amounts of volatile chemicals, so there is no hazardous or intrusive odor. Because the gypsum wall sheathing remains in place, a large quantity of solid waste is not generated and the retrofitting is completed in less time.

The system and method of the present invention provides a lower-cost, safer, and faster alternative to replacement of gypsum board with plywood, yet improves the shear strength of the retrofitted building at least as well as the plywood replacement method.

The invention will now be described in more particular detail with respect to the accompanying drawings, in which like reference numerals refer to like parts throughout. In the drawings, not all details of construction of the structures are shown, for the sake of clarity. However, the illustrated structures are intended to represent conventional structures that include framed walls with brittle wall sheathing, such as gypsum board.

DETAILED DESCRIPTION OF THE INVENTION

Figure 1:
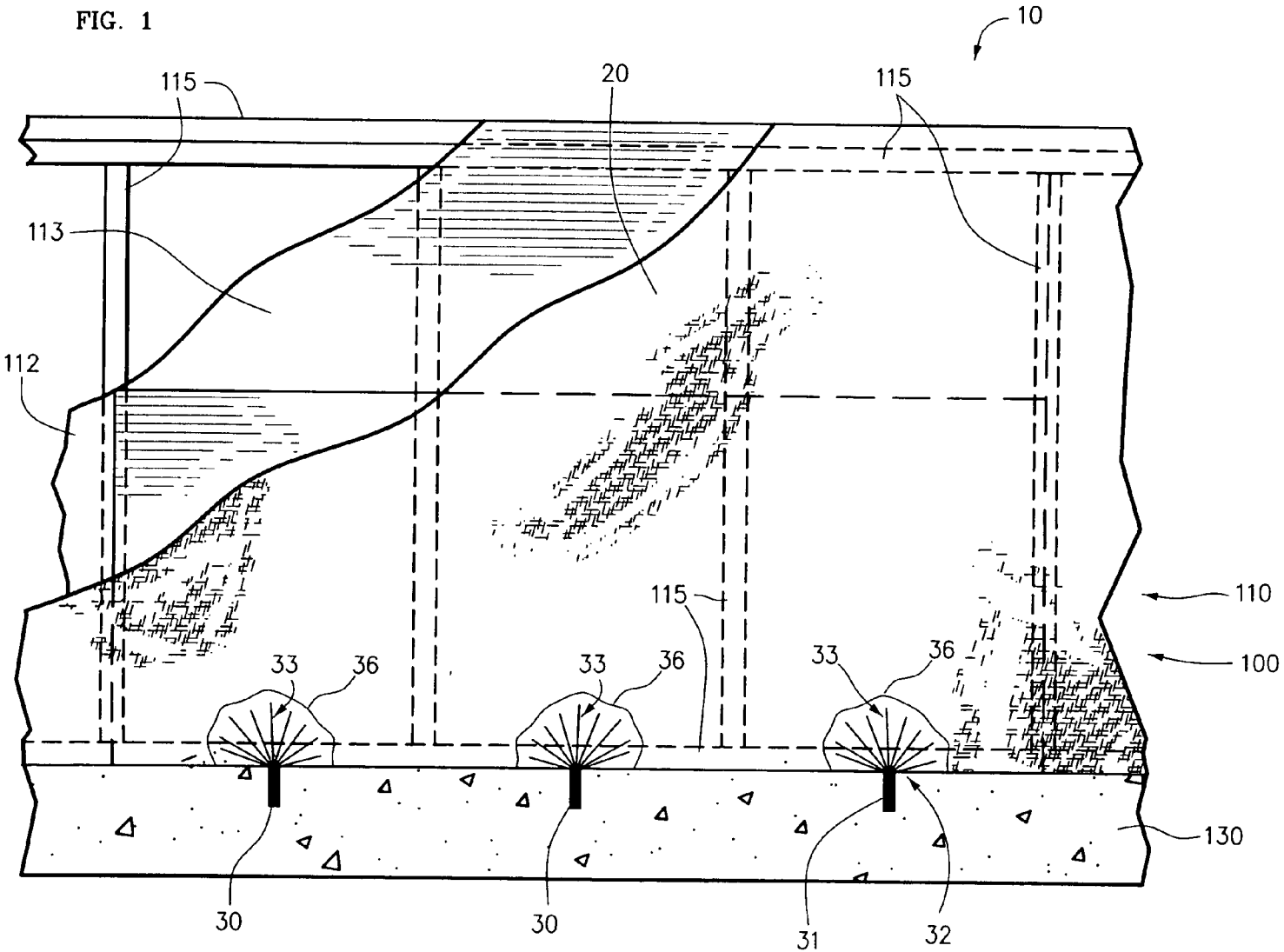
FIG. 1 is a front elevation view, cut away, of a first embodiment of the reinforcement system of the present invention reinforcing a conventional frame and gypsum board wall.

FIG. 1 is a front elevation view of reinforcement system 10 of the present invention reinforcing a portion of a structure 100, such as conventional frame wall 110 that is covered with a sheathing of gypsum board 112, which is partly cut away. Frame wall 110 includes framing members 115, vertical and horizontal members, typically of wood. Gypsum board 112 is nailed to framing members 115 to cover framing members 115 and give wall 110 a smooth outer surface 113. Wall 110 is supported by a foundation, such as concrete slab 130.

Reinforcement system 10 includes a sheet of textile 20, such as fabric that is woven or knit from fibers with high tensile strength. Textile 20 is stretched over surface 113 of gypsum board 112 and attached by suitable means, such as adhesive. Adhesive may be previously applied to surface 113 before textile 20 is stretched over surface 113, or textile 20 may be stretched and temporarily attached, such as with staples, then adhesive may be sprayed or rolled on over textile 20 to attach textile 20 to surface 113.

Preferably, textile 20 is a panel of fabric that is pre-impregnated with synthetic resin, such as epoxy, urethane, or other polymers as are well-known in the art. Most preferably, the impregnation step has been performed at another location and most solvents or other volatile components of the resin have already evaporated. The "B-stage" gel that remains in textile 20 thus has low odor and low human toxicity via respiration. The B-stage panel of textile 20 is flexible and easy to cut, drill, or punch, but is not so sticky that it is difficult to handle.

This type of textile panel is commonly known as "prepreg" or "FRP" (fiber-reinforced polymer). The fiber portion of the panel is typically woven or knitted filaments of glass or graphite carbon. A suitable FRP panel typically is tacky enough to adhere lightly to a wall upon contact, then cures at ambient temperature over a period of hours or days to become tightly adhered. Such a panel may also be applied to a ceiling, but may require an additional tack coat of liquid or pasty adhesive to hold it in place during curing. Light mechanical fasteners such as staples may also be used.

If textile 20 is not pre-impregnated with resin, various means for attaching textile 20 to wall 110, as are known in the art, may be used. For example, textile 20 may be run between rollers that apply a suitable adhesive. Alternatively, textile 20 may be stretched over surface 113 then suitable adhesive is applied over textile 20 such as by brush or spray. The adhesive will penetrate textile 20 and adhere to surface 113.

Examples of suitable adhesives include epoxy, polyurethane, latex, and acrylic. It is preferred that the adhesive used should be low in volatile emissions during curing and that any vapors emitted be low toxicity and low odor.

For maximum improvement of ductility and strength, textile 20 is attached to wall 110 substantially coplanar, so as to largely cover wall 110. That is, textile 20 is not attached to wall 110 such as by edges only or by intermittent areas of adhesive. Textile 20 is preferably attached across its entire wall-facing surface to surface 113 of wall 110.

Fiber anchors 30, as are known in the art and disclosed in U.S. Pat. No. 7,207,149, are installed along one or more edges of wall 110. Boreholes 31 are drilled into an anchor medium adjacent wall 110, such as into slab 130, into the soil supporting structure 100, or into a frame member 115 of wall 110 or a frame member 115 of an adjacent floor or level of structure 100.

Boreholes 31 are typically drilled into a framing member 115 near the top or bottom of wall 110. However, a borehole 31 can optionally be drilled through gypsum board 112 and into an underlying framing member 115 in order to install a fiber anchor 30 that is not disposed at an edge of wall 110.

A length of roving 32, composed of loosely twisted filaments of ductile, strong fiber, is inserted into each borehole 31 with a free end 33 protruding. Free end 33 of roving 32 is splayed out against textile 20 and attached to textile 20 with a suitable adhesive 36.

One preferred method of practicing the invention is to first attach textile 20 to surface 113, then to attach free end 33 over textile 20 such that free end 33 is attached with adhesive 36 to the outer surface of textile 20. A second preferred method of practicing the invention is to attach free end 33 directly to surface 113 of wall 110, then to attach textile 20 with adhesive such that free end 33 is attached to the inner surface of textile 20.

In the exemplary embodiment of the illustrations, a plurality of fiber anchors are shown as arrayed along the sill of wall 110 with boreholes 31 drilled into slab 130. The combination of textile 20 and fiber anchors 30 provide a strong ductile connection between slab 130 and wall 110, reinforcing wall 110 against being disconnected from slab 130 by strong lateral force, such as from an earthquake. Perhaps more importantly, textile 20 increases the ductility of surface 113 of wall 110, making gypsum board 112 unlikely to rupture catastrophically.

To reinforce connection among floors of a structure, anchors 30 may be installed such that borehole 31 is drilled into a frame member 115 of an adjacent floor. For example, borehole 31 may be drilled upwardly into a support member 115 of the floor above. In this case, free end 33 would extend downward and be splayed against an upper portion of surface 113 of wall 110.

It is also within the scope of the present invention to drill borehole 31 through an adjacent frame member 115, such as a joist or beam, and insert roving 32 through borehole 31 such that a free end 33 protrudes from each end of borehole 31. A first free end 31 is splayed and attached to a first wall, ceiling, or floor; and a second free end 31 is splayed and attached to a second wall, ceiling, or floor.

From observing the effects of actual strong earthquakes and simulated earthquake tests on conventional structures 100, non-reinforced gypsum board 112 has been found to respond in a brittle manner, cracking and rupturing away from framing members 115. Once gypsum board 112 ruptures, it contributes no strength to wall 100, allowing framing members 115 to bend their connections, typically nails, screws, or brackets, so as to allow wall 100 to collapse. This type of failure in one section of wall 110 may lead to further failures in other sections of structure 110.

Reinforcement system 10 of the present invention increases the ductility of wall 110 and connects wall 110 to the foundation, such as slab 130 or a lower floor (not shown) of structure 100, in a strong ductile manner. Even under strong lateral forces, such as from a major earthquake, reinforced structure 100 maintains connection among all components such as framing members 115, gypsum board 112, and slab 130. As long as all the components of structure 100 remain connected, they act cooperatively to maintain structure 100 in a non-collapsed state, even if some lesser damage such as breaking of windows occurs. It has been found in laboratory testing that reinforced gypsum board 112 may crack, but because it is supported against rupture by textile 20, gypsum board 112 remains attached to framing members 115 and does not fully break or collapse.

Figure 2:
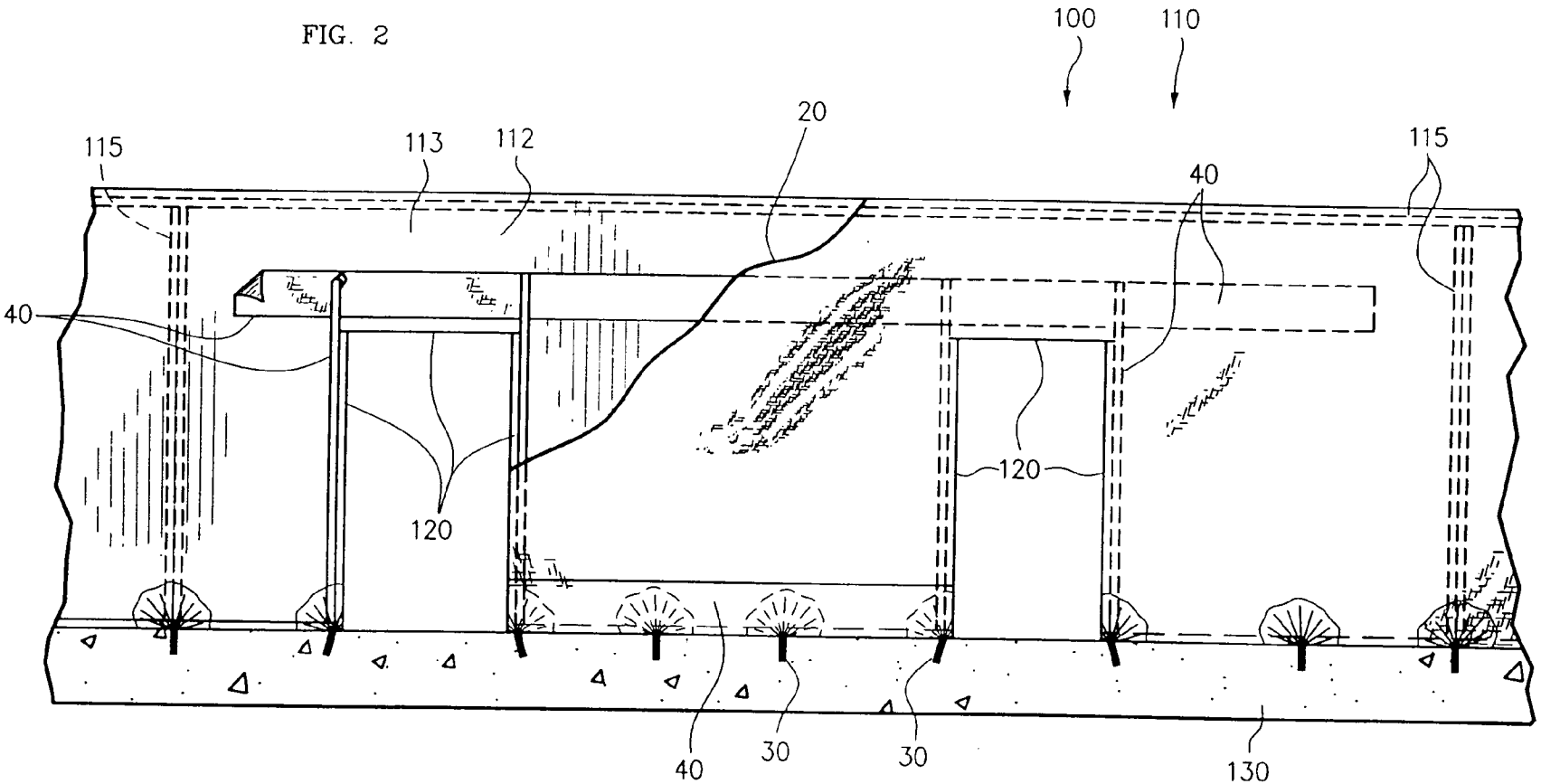
FIG. 2 is a front elevation view, cut away, of a second embodiment of the reinforcement system of the present invention reinforcing a wall that includes other structural elements, namely door frames.

FIG. 2 is a front elevation view of a second embodiment of reinforcement system 10 of the present invention reinforcing a wall 110 that includes other structural elements, namely door frames 120. Wall 110 is sheathed by gypsum board 112 and is reinforced with textile 20, shown partly cut away, and fiber anchors 30 of the type previously discussed.

Some structures 100 may need further reinforcement among individual components, such as connecting door frames 120 to reinforced wall 110 to prevent them from separating from wall 110 and toppling to one side or the other of wall 100 under strong lateral forces. In the past, people were advised to take refuge in a doorway during a strong earthquake and many people still do this. Thus, it is especially desirable that door frames 120 not separate from wall 110, possibly injuring a person trying to shelter in the door opening.

In conventional structures 100 that experience strong lateral forces, especially forces that change direction such as earthquakes, certain structural components such as door frames 120 may sway with a different frequency than the sway frequency of the rest of wall 110 or structure 100. The unsynchronized swaying may cause gypsum board 112 around door frames 120 to crack or rupture, allowing door frames 120 to separate from wall 110 and possibly topple away from wall 110.

To further reinforce structural components that are not strongly connected to the rest of structure 100, such as door frames 120, long "drag" or "collector" strips 40 of textile 20 connect a plurality of door frames 120. As shown in FIG. 2, each door frame has two vertical collector strips 40 attached generally over or in proximity to the vertical members of the door frame 120. A long horizontal collector strip 40 is attached above door frames 120; horizontal strip 40 is attached with a suitable adhesive to surface 113 and to the vertical collector strips 40. The adhesive used to attach connector strips 40 may be the same as used to attach textile 20, but different adhesive may also be used. Collector strips 40 may alternatively be additionally attached to framing members 115 with mechanical fasteners, such as screws (not shown) to further increase the strength of the structure.

Drag, or collector, strips 40 provide strong ductile connection among door frames 120 and connect door frames 120 to other structural components, such as wall 110. In the event of a major earthquake or other strong lateral force, such as from a hurricane or explosion, door frames 120 will sway in unison with framing members 115 and reinforced gypsum board 112 instead of breaking away from them.

In like manner, collector strips 40 may be employed to reinforce the connection among many structural components, including but not limited to doors, windows, tilt-up walls, chimneys, and balconies. Collector strips 40 are not always required, but may be optionally employed to meet the requirements of a given application.

Collector strips 40 are optionally used to create a load path among floors or other portions of a structure 100. A slot may be cut, such as through a ceiling or floor, to allow a collector strip 40 to be passed through. Collector strip 40 is then attached by suitable adhesive to surfaces 113 of walls 110 on different floors of structure 100, or to framing members 115 or other components of structure 100, as appropriate. For creating a load path through structure 110, collector strip may be oriented vertically, horizontally, or at an angle.

Another preferred use of collector strips 40 is to buttress the attachment of fiber anchors 30 to surface 113, as seen in the middle portion of FIG. 2. An elongate collector strip 40 about 12 wide may be placed over a plurality of anchors 30, whether anchors 30 are disposed along the bottom or the top of wall 110.

System 10 of the present invention is described herein as being useful for reinforcing walls that are covered, or sheathed, with gypsum board 112, often known as drywall or sheetrock. While there are very many gypsum board walls urgently in need of reinforcement, there are also other types of structural components that can be reinforced using system 10. For example, reinforcement system 10 may be used to strengthen walls that are sheathed with plywood, if a very strong and ductile wall is required. Reinforcement system 10 is most simply applied to planar surfaces, such as wall 110 described herein, but may be employed to connect walls that are at an angle to each other, including both "inside" and "outside" right angles.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A reinforcing system to increase the shear strength of: a structure having a wall with wall sheathing having a surface; the structure including an aperture communicating between two adjacent floors of the structure; said system including:

a fabric sheet attached to the surface of the wall sheathing by suitable means;

at least one fiber anchor; including:

a borehole in an anchor medium adjacent the wall;

a length of roving inserted into said borehole with a free end protruding;

said free end attached to said fabric sheet by suitable adhesive means; and backfill material for anchoring said roving within said borehole; and an elongate connector strip attached to two adjacent walls, such that a first end of said connector strip is attached to a first wall on a first floor; and a second end of said connector strip is attached to a second wall on a second, adjacent floor; and the middle portion of said connector strip is disposed in the aperture between the first and second floors.

2. A reinforcing system to increase the shear strength of: a structure having a wall with wall sheathing having a surface, and one or more door or window openings having a tendency to separate from the wall when experiencing strong lateral forces; said system including:

a fabric sheet attached to the surface of the wall sheathing by suitable means;

at least one fiber anchor; including:

a borehole in an anchor medium adjacent the wall;

a length of roving inserted into said borehole with a free end protruding;

said free end attached to said fabric sheet by suitable adhesive means; and backfill material for anchoring said roving within said borehole and: at least one connector strip of fabric material attached to the wall by suitable means such that said strip reinforces the connection to the wall of at least one door or window frame.

3. The system of claim 2; said connector strip further connecting together two or more door or window openings having a tendency to separate from the wall when experiencing strong lateral forces.

4. The system of claim 2; said fabric sheet being attached to the surface of the wall sheathing by adhesive means; and said connector strip being attached by adhesive means.

5. The system of claim 2, wherein: said connector strip is attached to the surface of the wall sheathing such that said fabric sheet is disposed between said connector strip and the surface of the wall.

6. A reinforcing system for retrofitting a structure to improve the resistance to earthquake and other lateral force, the structure including: at least two walls adjacent and connected to each other, each wall having an outer surface; said system including:

at least one panel of fiber-reinforced polymer attached partly to the outer surface of a first wall and partly to the outer surface of a second wall;

at least one fiber anchor; including:

a borehole in an anchor medium adjacent the wall;

a length of roving inserted into said borehole with a free end protruding;

said free end attached to the wall by suitable adhesive means; and backfill material for anchoring said roving within said borehole.

* * * * *